US007232055B1

(12) United States Patent
Lim

(10) Patent No.: US 7,232,055 B1
(45) Date of Patent: Jun. 19, 2007

(54) FOLDING SERVING TRAY

(76) Inventor: Edmond Heng Lim, 1745 Walnut St., El Cerrito, CA (US) 94530

( * ) Notice: Subject to any disclaimer, the term of this patent is extended or adjusted under 35 U.S.C. 154(b) by 503 days.

(21) Appl. No.: 10/749,058

(22) Filed: Dec. 30, 2003

(51) Int. Cl.
*B65D 5/48* (2006.01)
*B65D 25/04* (2006.01)

(52) U.S. Cl. ..... 229/120.18; 206/217; 206/565; 229/904; 229/906

(58) Field of Classification Search ..... 229/120.18, 229/198.2, 904, 906; 206/217, 218, 561, 206/562, 563, 564, 565; 220/737
See application file for complete search history.

(56) References Cited

U.S. PATENT DOCUMENTS 3,201,024 A * 8/1965 Brokop ..... 229/904
3,400,875 A * 9/1968 Coe ..... 206/563
3,497,127 A * 2/1970 Box ..... 229/198.2
4,278,197 A * 7/1981 Scheinbaum et al. ..... 206/562
4,981,217 A * 1/1991 Lim ..... 206/561
5,381,949 A * 1/1995 Correll ..... 229/198.2
5,593,062 A * 1/1997 Martin ..... 220/574.1
5,607,077 A * 3/1997 Torkelson ..... 206/217
6,216,946 B1 * 4/2001 Cai ..... 229/904
6,401,927 B1 * 6/2002 Sorensen et al. ..... 206/562
6,708,874 B1 * 3/2004 Montgomery ..... 229/117.16
6,892,932 B2 * 5/2005 Correll ..... 229/120.18
7,025,199 B1 * 4/2006 Lim ..... 206/217

FOREIGN PATENT DOCUMENTS

FR 2592571 A1 * 7/1987

* cited by examiner

*Primary Examiner*—Gary E. Elkins
(74) *Attorney, Agent, or Firm*—Risto A. Rinne, Jr.

(57) ABSTRACT

An apparatus for containing a food and beverage includes a substantially flat stock, for example, cardboard or fiberboard that is folded into a three-dimensional apparatus. When formed, the apparatus includes a first compartment for holding a food and a beverage extension section adapted for holding a beverage. Certain of the sections include panels that interlock. A reinforcing member is provided to add strength to the beverage extension portion. A pair of thumbholes are provided in two of the sections and a pair of slots are provided for securing a pair of eating utensils, for example, a fork and spoon. The unused thumbhole is adapted to receive a napkin.

14 Claims, 3 Drawing Sheets

FOLDING SERVING TRAY

BACKGROUND OF THE INVENTION

1. Field of the Invention

The present invention, in general relates to paper plates and, more particularly, a serving tray that is shipped flat and folded open into a three-dimensional tray.

Paper plates are well known. Variations include serving trays that are folded from a flat sheet into a substantially three-dimensional structure. These are often used in the food service industry to contain food that is to be consumed. They are typically discarded after a single use.

For example, these prior devices often form a simple tray with vertical sides and open top when folded open. They are used for a variety of purposes, some of which include holding French Fries, hamburgers, hot dogs, and other typical fast food items but not a drink cup or can. They are used in ball parks and by various food vendors.

While useful, there are needs that all known prior types of devices fail to satisfy. For example, the prior known folding serving trays either cannot or have great difficulty simultaneously holding a beverage. This is because a beverage is heavy and the thin cardboard (i.e., fiberboard) used for such construction fails to support the beverage which can tilt and spill as the support fails. A hot beverage that is spilled on a person can cause injury which is a liability risk. Also, prior types tend to support conical shaped coffee cups but not also cylindrical containers, for example, soda cans.

Another need is to provide a way to hold the serving tray at a balance point, proximate a center of gravity when it is loaded.

This need extends to both right and left-handed users.

There is also a need to be able to store eating utensils, for example a plastic fork or spoon, most typically being used, simultaneously while the food is contained in the tray.

There is also a need to store a napkin.

An especially important need is for the container to retain its "folded-open" position. The sides of previous trays tend to be easily displaced, especially so when the weight of contents in the tray bears upon the sides of the tray. This can cause food items placed therein to spill out of the tray. Food spilled on a person can ruin clothes which is another liability risk. There is a need to ensure that a folding serving tray, once folded into the open position adapted for use, stays in that position.

Accordingly, there exists today a need for a folding serving tray that helps ameliorate the above-mentioned difficulties.

Clearly, such an apparatus would be a useful and desirable device.

2. Description of Prior Art

Paper plates and trays are, in general, known. For example, the following patent describes a similar type of device:

U.S. Pat. No. 4,981,217 to Edmond Lim, Jan. 1, 1991.

While the structural arrangements of the above described device, at first appearance, has similarities with the present invention, it differs in material respects. These differences, which will be described in more detail hereinafter, are essential for the effective use of the invention and which admit of the advantages that are not available with the prior device.

OBJECTS AND SUMMARY OF THE INVENTION

It is an object of the present invention to provide a folding serving tray that is formed out of a flat stock.

It is also an important object of the invention to provide a folding serving tray that is formed from a cardboard.

Another object of the invention is to provide a folding serving tray that is formed from a fiberboard.

Still another object of the invention is to provide a folding serving tray that can be shipped flat and folded open for use.

Still yet another object of the invention is to provide a folding serving tray that can be quickly folded open for use.

Yet another important object of the invention is to provide a folding serving tray that includes panels that can be locked into position once the tray has been opened.

Still yet another important object of the invention is to provide a folding serving tray that includes panels that resist dislodging after assembly has occurred.

A first continuing object of the invention is to provide a folding serving tray that includes a compartment for holding a beverage that includes a reinforcement member.

A second continuing object of the invention is to provide a folding serving tray that includes a compartment for holding a beverage in either a straight-sided cylindrical container or in a tapered frusta-conical shaped container.

A third continuing object of the invention is to provide a folding serving tray that includes a beverage compartment with a support thereunder.

A fourth continuing object of the invention is to provide a folding serving tray that includes a thumbhole that is located proximate a center of gravity of the tray when it is loaded with a typical assortment of food-related, consumable items.

A fifth continuing object of the invention is to provide a folding serving tray that includes a pair of thumbholes, one on each side of the container, for either right or left-hand use.

A sixth continuing object of the invention is to provide a folding serving tray that includes a pair of thumbholes, an unused one thereof being adapted to receive a napkin therein.

A seventh continuing object of the invention is to provide a folding serving tray that is adapted to secure a fork, spoon, or knife.

An eighth continuing object of the invention is to provide a folding serving tray that is adapted to secure two utensils at the same time, for example, a spoon and a fork simultaneously.

A ninth continuing object of the invention is to provide a folding serving tray that is economical to manufacture.

A tenth continuing object of the invention is to provide a folding serving tray that is economical to transport.

An eleventh continuing object of the invention is to provide a folding serving tray that takes up little room when flat and therefore is economical to store.

A twelfth continuing object of the invention is to provide a folding serving tray that can be stamped in one operation.

A thirteenth continuing object of the invention is to provide a folding serving tray that is a one-piece contiguous device, wherein no additional parts or pieces are required for assembly.

Briefly, a folding serving tray that is constructed in accordance with the principles of the present invention is formed from a substantially flat stock, for example, cardboard or fiberboard. When formed, the flat stock includes a variety of sections that include either cuts or perforations to aid in creasing (i.e., bending) portions thereof. The sections fold to produce a three dimensional tray that includes a first compartment for holding a food and a beverage extension for holding a beverage. Certain of the sections form panels that interlock together. A reinforcing member is provided to add strength to the beverage extension portion. A pair of thumbholes are provided in two of the sections and a pair of slots are provided for securing a pair of eating utensils, for example, a fork and spoon. The unused thumbhole is adapted to receive a napkin.

DETAILED DESCRIPTION OF THE INVENTION

Figure 1:
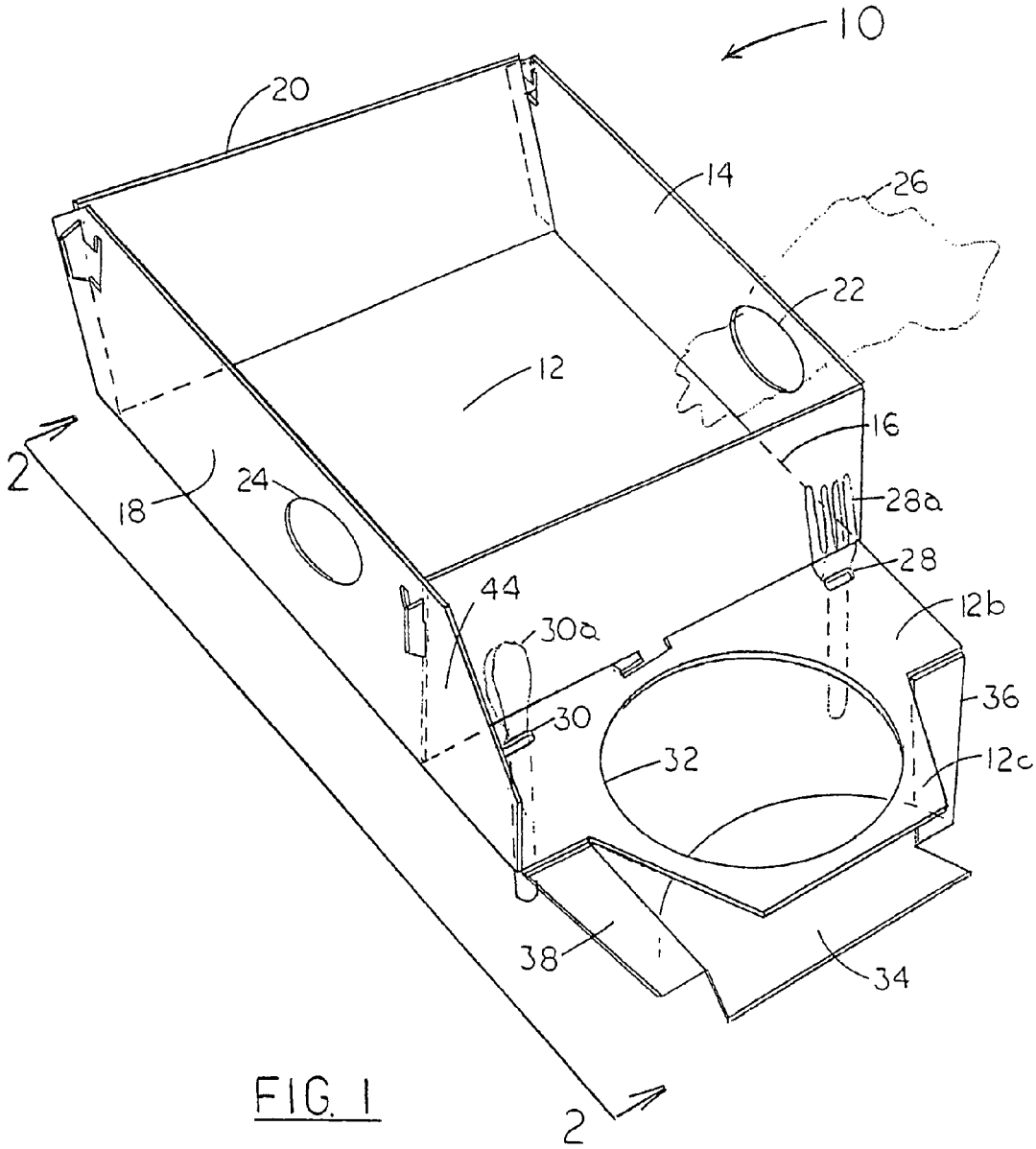
FIG. 1 is a view in perspective of a folding serving tray, assembled and ready for use.
Figure 2:
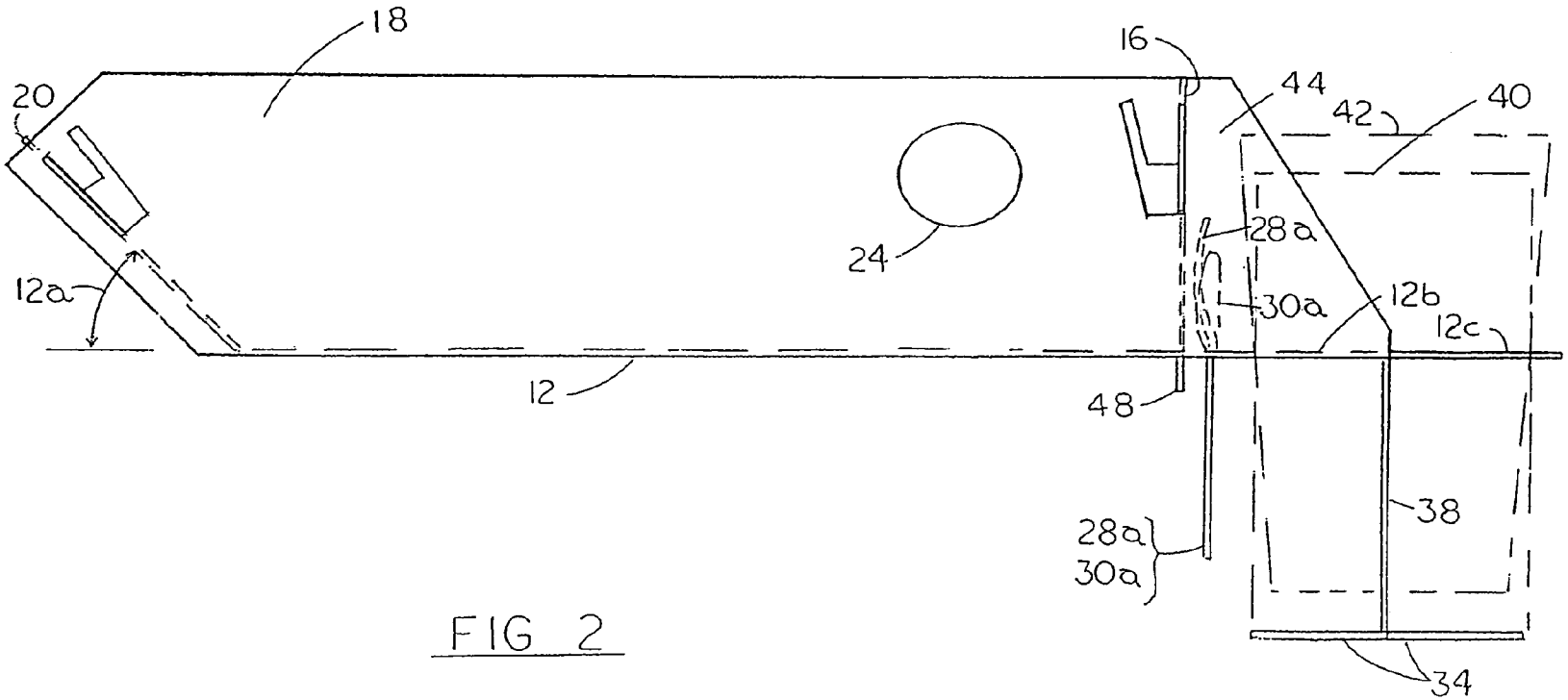
FIG. 2 is a view as shown in FIG. 1 as seen along the lines 2-2 therein.

Referring on occasion to all of the drawings and now, in particular, alternately to both FIG. 1 and FIG. 2 is shown, a folding serving tray, identified in general by the reference numeral 10.

The folding serving tray 10 includes a center panel 12, an upright first panel 14, an upright second panel 16, an upright third panel 18, and an upright fourth panel 20. The first, second, third, and fourth panels 14, 16, 18, 20, are disposed at an angle with respect to the center panel 12 when the folding serving tray 10 is assembled for use.

The preferred angle for the first, second, and third panels 14, 16, 18 is ninety degrees and for the fourth panel 20 is less than ninety degrees, measuring up to it from an extended plane 12*a* of the center panel 12 (see FIG. 2). Of course, if desired, any of the angles could be modified.

The center panel 12 extends out beyond the second panel 16, when assembled, and includes a main portion of a beverage extension section 12*b* of the center panel 12.

The first panel 14 includes a first thumbhole 22 and the third panel 18, which when assembled is opposite the first panel 14 and parallel thereto, includes a second thumbhole 24. The first and second thumbholes 22, 24 include a common center axis when the folding serving tray 10 is assembled.

The first and second thumbholes 22, 24 are also disposed substantially closer to the second panel 16 than to the fourth panel 20, when the folding serving tray 10 is assembled. This position is selected to provide an average center of gravity location.

If the user is right handed, a thumb (not shown) of the right hand passes through the second thumbhole 24 entering from the outside of the third panel 18. A palm of the right hand (not shown) passes under the center panel 12 underneath the second thumbhole 24.

This location is optimally stable for all variations. If a beverage and typical food items are included it, on average, approximates the location of the center of gravity of the loaded folding serving tray 10 making carrying it as easy and safe as possible. If a beverage and no food items are placed in the folding serving tray 10, this location still affords excellent control as it does if food items and no beverage are placed in the folding serving tray 10.

If the user is left handed the process is reversed. A thumb (not shown) of the left hand passes through the first thumbhole 22 entering from the outside of the first panel 14. A palm of the left hand (not shown) passes under the center panel 12 underneath the first thumbhole 22.

If a user wished to attain maximum stability, both hands could be simultaneously used to carry the folding serving tray 10 in front of the user's torso. However, this is seldom expected to occur.

Rather, an unused one of the two thumbholes 22, 24 is expected to receive a napkin 26 (shown in dashed lines in the first thumbhole 22, FIG. 1).

The beverage extension section 12*b* includes a first slot 28 and a second slot 30 that are cut out during manufacture. More slots (not shown) could of course be added, if desired. The slots 28, 30 are intended to receive a handle end of a fork 28*a* and a spoon 30*a* or other eating utensil, as desired. Typically, the fork 28*a* and the spoon 30*a* will be disposable plastic ones, although this is not required.

If additional slots are also included, they preferably are not to be included along the same line as are the first and second slots 28, 30 located because it is not desirable to provide a line of weakness. If desired, the first and second slots 28, 30 can also be offset slightly so that they do not share a common longitudinal axis.

The beverage extension section 12*b* includes a larger beverage opening 32 that is preferably circular. A beverage support panel 34 is attached to a first end of a first beverage support arm 36 on one side thereof and to a first end of a second beverage support arm 38 on a remaining side thereof.

An opposite end of the first and second beverage support arms 36, 38 is attached to the beverage extension section 12*b*.

Referring in particular now to FIG. 2, a can of soda 40 is placed in the beverage opening 32 with a bottom end of the can of soda 40 in dashed lines resting flat on top of the beverage support panel 34. The diameter of the can of soda 40 is less than that of the beverage opening 32. Were it not for the beverage support panel 34, the can of soda 40 would fall through to the ground.

A tapered beverage cup 42, for example a Styrofoam cup of coffee, in dashed lines is also shown as an alternative beverage and container for the beverage that are suitable for use with the folding serving tray 10.

The tapered beverage cup is substantially frusta-conical in shape and it is inserted into the beverage opening 32 until its outside diameter equals that of the beverage opening 32. A friction fit then occurs to secure the tapered cup 42 in place.

The weight of the beverage 40, 42 is substantial. It is difficult for any type of a folding tray to support such weight. The folding serving tray 10 includes two features that easily permit it to support the weight of the beverage 40, 42.

The third panel 18 includes a gusset panel 44 that extends beyond the second panel 16 when the folding serving tray 10 is assembled. The gusset panel 44 provides a reinforcing member that extends from a top of the third panel 18, a side panel that is in alignment with the gusset panel 44, to one side of the beverage extension section 12*b*. The main portion of the beverage extension section 12*b* extends out away from the second panel to about a center line 32*a* of the beverage opening 32 where the beverage extension section 12*b* is attached.

A minor portion 12*c* of the beverage extension section 12*b* extends beyond the center of the beverage opening 32 to provide a containment ring for the beverage 40, 42. The minor portion 12*c* of the beverage extension section 12*b* experiences little force other than to keep the top of the beverage 40, 42 from tilting outward and spilling.

The gusset panel 44 is preferably attached to the beverage extension section 12*b* along its entire length. As the beverage extension section 12*b* exerts a force, under weight of the beverage 40, 42, that attempts to lower the beverage extension section 12*b*, the gusset panel 44 conveys this force up to the third panel 18. The material that is used to form the folding serving tray 10 has good tensile strength and therefore is easily able to resist extension and bear the weight of the beverage 40, 42.

It is noted that the folding serving tray 10 is formed of any desired material that is substantially planar. Cardboard and fiberboard are preferred materials because they are strong, lightweight, and inexpensive. A material having the stiffness of a good quality paper plate or better is preferred.

If desired, plastics and other materials could be used. For certain applications, the folding serving tray 10 may be cleaned and reused. A higher quality material, for example a durable plastic, may then be used. One such possible application is for home party use. Several of the folding serving trays 10 are used for picnics, birthday parties, and the like. Afterwards, they are washed and disassembled so that they are again flat. Then they are stored flat, ready for the next party or picnic.

The second support mentioned earlier that helps to retain the beverage 40, 42 is described in greater detail hereinafter.

Figure 3:
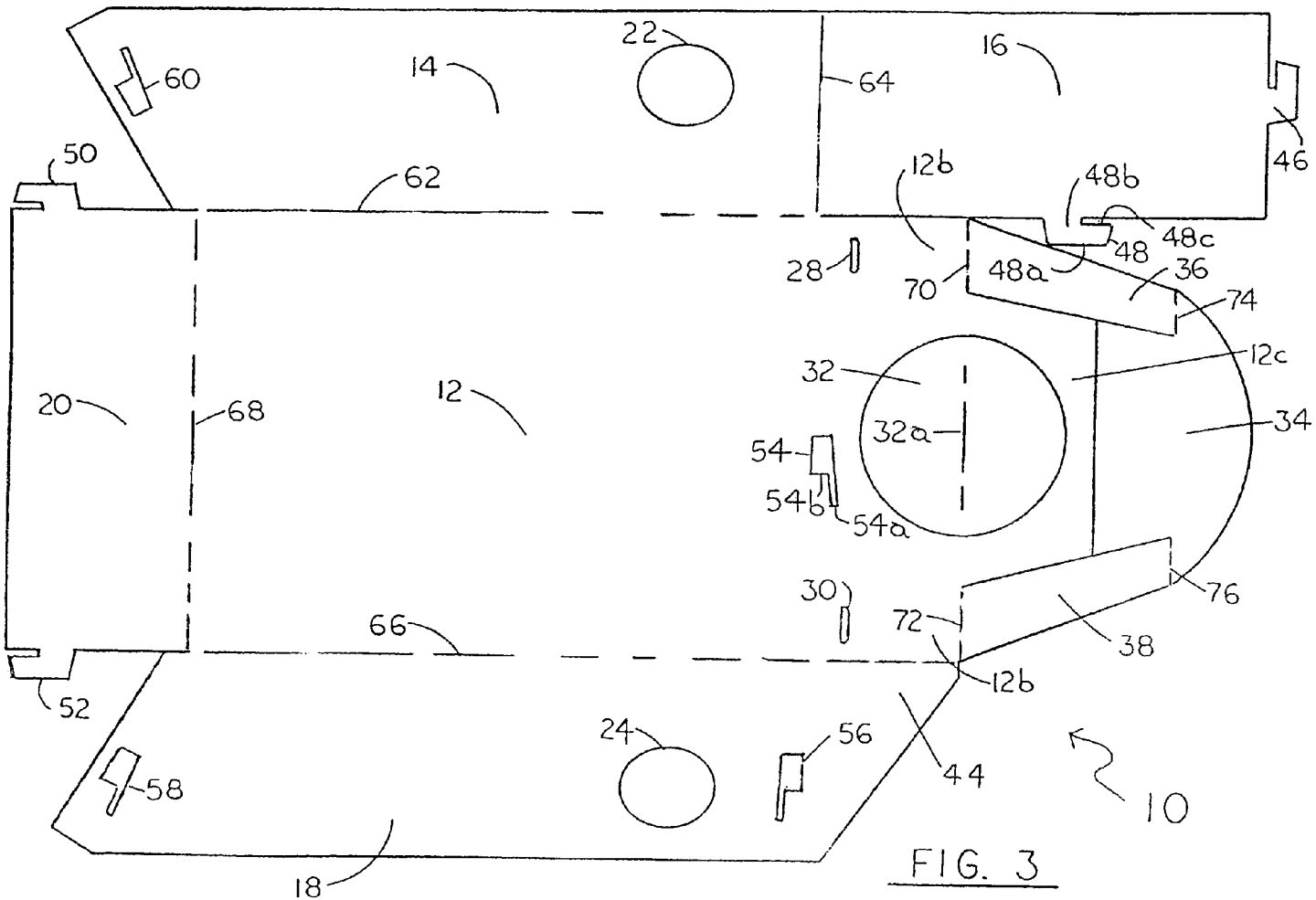
FIG. 3 is the folding serving tray of FIG. 1 in a flat state, after manufacturing, prior to assembly for use.

Referring now also with regularity to FIG. 3, the second panel 16 includes a first locking tab 46 and a second locking tab 48. The fourth panel 20 includes a third locking tab 50 and a fourth locking tab 52.

The center panel 12 includes a first locking opening 54. The third panel 18 includes a second locking opening 56 and a third locking opening 58. The first panel 14 includes a fourth locking opening 60.

Each of the locking tabs 46, 48, 50, 52 cooperates with one of the locking openings 56, 54, 60, 58, respectively. The first locking tab 46 cooperates only with the second locking opening 56. The second locking tab 48 cooperates only with the first locking opening 54. The third locking tab 50 cooperates only with the fourth locking opening 60. The fourth locking tab 52 cooperates only with the third locking opening 58.

The following detailed description for assembly of one of the locking tabs 48 as it cooperates with one of the locking openings 54 applies to each of the locking tabs 46-52 and to each of the corresponding locking openings 54-60. Each of the locking openings 54-60 includes an important shape that includes a first elongated portion 54*a* and a second shorter portion 54*b* that are joined together in the middle. The elongated portion is long enough to accept entry of an outer portion 48*a* of the corresponding locking tab (48). The outer portion 48*a* is attached to one end of an intermediate member 48*b* that is shorter than the outer portion 48*a*. The remaining end of the intermediate member 48*b* is attached to an edge of one of the panels (16).

The locking tab 48 is pushed in through the first elongated portion 54*a* of the corresponding locking opening 54 until the outer portion 48*a* of the locking tab 48 is disposed under the panel 12. Then the locking tab 48 is urged in a direction that is parallel with the plane of the panel 12 that includes the locking opening 54 in a direction that is away from the first elongated portion 54*a* and toward the second shorter portion 54*b* of the locking opening 54. A nose portion 48*c* of the outer portion 48*a* of the locking tab 48 is then disposed under the panel 12 proximate the second shorter portion 54*b* of the locking opening 54. This prevents an outward force from dislodging the locking tab 48 out of the locking opening 54.

To release the locking tab 48 from a position of cooperation with the corresponding locking opening 54, the locking tab 48 must first be urged parallel with the plane of the panel 12 that includes the locking opening 54 toward the first elongated portion 54*a* and then it can be separated (i.e., pulled away) from the panel 12 that includes the locking opening 54. This procedure, for locking and unlocking, applies to any of the locking tabs and openings. Accordingly, means are provided to ensure that the folding serving tray 10, once assembled, cannot unintentionally be opened.

It is important to note that in FIG. 3, a way to differentiate between cuts in the folding serving tray 10 and fold lines (or creases) needs to be provided. Cuts are shown in solid lines. Fold lines are shown in dashed lines (with the one exception of the center line 32*a* of the beverage opening 32 which is also shown in dashed lines). The folding serving tray 10 includes a first fold line 62, a second fold line 64, a third fold line 66, a fourth fold line 68, a pair of fifth and sixth fold lines 70, 72 that are disposed along a first extended fold line, and a pair of seventh and eighth fold lines 74, 76 that are disposed along a second extended fold line.

The fold lines 62-76 may include a crease that is added during manufacture to assist folding and help influence the direction of folding so that it occurs as desired. The fold lines 62-76 may alternately include a series of perforations for that same purpose or a score line, of any combination of the above or any other known method to assist the folding serving tray 10 in causing the folding serving tray 10 to fold where desired and how desired.

Any enhancement method for folding the members of the folding serving tray 10 is best chosen to optimally work with the material that the folding serving tray 10 is formed of. For certain materials, merely including a visible fold line may be enough. For commercial applications where the folding is repetitive and becomes second nature, even the visible fold lines may be omitted.

To assemble the folding serving tray 10 for use, there is latitude as to which panel or panels are first assembled. What follows is one suggested procedure.

The folding serving tray 10, after manufacture, is flat as shown in FIG. 3. To begin assembly, the second panel 16 is raised upward along the second fold line 64 until it is nearly perpendicular with respect to the first panel 14. The first panel is similarly raised along the first fold line 62 until it is perpendicular with respect to the center panel 12.

The second locking tab 48 is inserted into the first elongated portion 54*a* of the first locking opening 54 and is generally urged toward the fourth panel 20 so as to displace the intermediate portion 48*b* of the locking tab 48*b* inside the second shorter portion 54*b*. This position ensures that the nose portion 48*c* will be disposed under the center panel 12 proximate the second shorter portion 54*b* of the first locking opening 54.

The second locking tab 48 is then locked in a position of cooperation with respect to the first locking opening 54 of the center panel 12. The center panel 12 is held adjacent to the underside of the second panel 16 by the nose portion 48*c* of the second locking tab 48. Any attempt to displace the center panel away from the second panel 16 is resisted by the nose portion 48*c* of the locking tab 48*b* which is then disposed under the center panel 12 proximate the second shorter portion 54*b*. This provides exceptional strength and rigidity to the folding serving tray 10 in addition to a means to ensure that the folding serving tray 10 stays assembled. It also allows for fast assembly of the folding serving tray 10.

The third panel 18 is similarly raised along the third fold line 66 until it is nearly perpendicular with respect to the center panel 12. The first locking tab 46 is then inserted into the elongated portion of the second locking opening 56 and is generally urged away from the fourth panel 20 to lock it in place, in a similar manner to that previously described.

At this time, the second panel 16, being supported at both ends, is especially strong and capable of resisting an increase in downward force that the second locking tab 48 may experience when a beverage 40, 42 is placed in the beverage compartment.

Accordingly, a second support (in addition to the gusset panel 44) is provided by the second locking tab 48 cooperating with the first locking opening 54 to support the weight of the beverage 40, 42.

The fourth panel 20 is then raised along the fourth fold line 68 to an angle that allows the third locking tab 50 to enter into the elongated portion of the fourth locking opening 60 and the fourth locking tab 52 to enter into the elongated portion of the third locking opening 58. The fourth panel 20 is then urged away from the second panel 16 sufficient to lock the third locking tab 50 and the fourth locking tab 52 in place.

As can be seen, any foodstuff placed on the center panel 12 is surrounded by the four raised panels 14-20. Any force exerted on the fourth panel 20 (by the weight of the foodstuff) tending to urge it away from the center panel 12 only further tends to secure the fourth panel 20 in the locked position, thereby ensuring that the fourth panel 20 cannot separate during use.

Similarly, a force tending to urge the second panel 16 away from the center panel 12 is prevented from doing so at an end of the second panel 16 where the first locking tab 46 is located because it only tends to secure the first locking tab 46 in place. The opposite end of the second panel 16 is attached to an end of the first panel 14 and therefore not prone to any movement away from the first panel 14.

In the preferred version of the folding serving tray 10, the angle that the fourth panel 20 is raised is less than ninety degrees but, if desired, it could be at ninety degrees thereby resulting in all four panels 14-20 being perpendicular with respect to the center panel 12. This is a matter of preference.

The folding serving tray 10 can be used to hold various foodstuffs as it is presently assembled. The fork 28*a* and spoon 30*a* are inserted as previously described.

Prior to inserting the can of soda 40 (as the beverage) into the beverage opening 32, the beverage support panel 34 is grasped and is urged downward. This urges the first beverage support arm 36 and the second beverage support arm 38 downward below the center panel 12. Each end of each of the beverage support arms 36, 38 bends around each corresponding one of the pair of fifth and sixth fold lines 70, 72 and the pair of seventh and eighth fold lines 74, 76 simultaneously until the beverage support panel 34 is disposed directly underneath the beverage opening 32. The can of soda 40 is then placed in the beverage opening 32 until its bottom is supported by the beverage support panel 34. The napkin 26, if desired, is inserted into an unused one of the two thumbholes 22, 24 and the folding serving tray 10 is fully assembled ready for use. When the beverage support panel 34 is urged downward, it can be rotated so that either side (the flat or curved side) faces inward.

If the folding serving tray 10 is to be disassembled, the process is reversed until disassembly is complete.

It is also noted that the folding serving tray 10 can be easily manufactured by stamping out its pattern onto the stock (i.e., material) that is used for its construction. All of the cuts occur automatically as do any desired perforations, score lines, or creases. It is further noted that very little of the stock is wasted as most of the area contains material that is used.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A folding serving tray made from a flat stock of material, comprising:

(a) a center panel;

(b) four sidewalls that extend upward with respect to said center panel, each of said sidewalls being attached at each end to another of said sidewalls, said four sidewalls forming a three-dimensional structure that is open on the top and closed on the bottom and which is adapted to receive an item to be served therein;

(c) an extension of said center panel that extends beyond one of said four sidewalls; said extension of said center panel adapted to receive a beverage therein; and (d) locking means for securing at least one portion of at least one of said four sidewalls to said center panel or to another of said four sidewalls; and (e) wherein said extension of said center panel includes a beverage opening adapted to receive said beverage therein and including a beverage support panel that is hingedly attached at one end of said beverage support panel to one end of a first beverage support arm and wherein said beverage support panel is hingedly attached at an opposite end to one end of a second beverage support arm and wherein an opposite end of each of said first and second beverage support arms is hingedly attached to said extension, and wherein said beverage support panel is adapted to be pivoted to a location that is below said beverage opening.

2. The folding serving tray of claim 1 including a gusset panel intermediate an end of one of said four sidewalls and at least a portion of said extension of said center panel.

3. The folding serving tray of claim 2 wherein said gusset panel is contiguous with respect to an end of one of said four sidewalls and said at least a portion of said extension of said center panel.

4. The folding serving tray of claim 3 wherein said gusset panel includes a substantially triangular shape.

5. The folding serving tray of claim 1 including a thumbhole in one of said four sidewalls.

6. The folding serving tray of claim 5 wherein said thumbhole is disposed closer to an end of one of said four sidewalls that is proximate said extension than to an end of said sidewall that is distally disposed with respect to said extension.

7. The folding serving tray of claim 5 wherein said thumbhole is disposed proximate a center of gravity of said tray when said tray is assembled and adapted to contain a typical assortment of items.

8. The folding serving tray of claim 5 including a second thumbhole that is disposed on a sidewall that is opposite said center panel with respect to said one of said four sidewalls that includes said thumbhole.

9. The folding serving tray of claim 8 wherein said thumbhole or said second thumbhole is adapted for placement of a thumb therein and a remaining one of said thumbhole or said second thumbhole is adapted to retain a napkin therein.

10. The folding serving tray of claim 1 wherein when said beverage support panel is disposed below said beverage opening, said beverage support panel is adapted to contact a bottom of a beverage container that is placed in said beverage opening and wherein said beverage support panel is adapted to provide sufficient support to retain said beverage container in said folding serving tray.

11. The folding serving tray of claim 1 including at least one slot adapted to receive an end of an eating utensil therein.

12. The folding serving tray of claim 11 including a plurality of slots, each slot adapted to receive an end of an eating utensil.

13. The folding serving tray of claim 1 wherein said locking means includes a tab that is attached to said at least one of said four sidewalls and a locking opening that is attached to said center panel or to said another of said four sidewalls wherein said tab is adapted to be inserted in said locking opening and wherein said locking opening is adapted to retain said tab in a position of cooperation with respect to said locking opening.

14. The folding serving tray of claim 13 wherein said tab includes an outer portion that is disposed maximally away from said at least one panel, said outer portion being attached to one end of an intermediate member, said intermediate member including an opposite end that is attached to said at least one panel, and wherein said outer portion includes a length that is greater than said intermediate member and wherein said tab is adapted to enter into said locking opening in said another panel and wherein said locking opening further includes a first elongated portion and an adjoining second shorter portion and wherein said first elongated portion includes a length that is greater than said second shorter portion, and wherein said length of said elongated portion is sufficient to allow said outer portion of said locking tab to pass through said locking opening at said first elongated portion so that all of said outer portion extends beyond said another panel and wherein said shorter portion includes a length that is less than necessary to allow said outer portion of said locking tab to pass through said shorter portion, and wherein said locking tab is adapted to be urged toward said shorter portion an amount that is sufficient to dispose a nose portion of said outer portion beyond said shorter portion sufficient to prevent said outer portion of said locking tab from passing through said shorter portion of said locking opening.

* * * * *